US005973711A

United States Patent [19]

Schartner et al.

[11] Patent Number: 5,973,711

[45] Date of Patent: Oct. 26, 1999

[54] TWO-SIDED COLOR PRINTING APPARATUS

[75] Inventors: Zachery J. Schartner, Narragansett; David M. Gaskill, Providence; Scott J. Cerullo, West Warwick, all of R.I.

[73] Assignee: Astro-Med, Inc., West Warwick, R.I.

[21] Appl. No.: 08/971,000

[22] Filed: Nov. 14, 1997

[51] Int. Cl.[6] ..... B41J 2/325; B41J 2/525

[52] U.S. Cl. ..... 347/173

[58] Field of Search ..... 347/172, 173, 347/197; 400/120.01, 120.02, 120.04, 120.16

[56] References Cited

U.S. PATENT DOCUMENTS

| | | | |
|---|---|---|---|
| 4,410,897 | 10/1983 | Moriguchi et al. . | |
| 4,811,036 | 3/1989 | Gaskill et al. . | |
| 4,857,941 | 8/1989 | Kaida . | |
| 5,298,924 | 3/1994 | Matsumoto | 347/172 |
| 5,486,057 | 1/1996 | Skinner et al. . | |
| 5,675,369 | 10/1997 | Gaskill | 347/173 |

FOREIGN PATENT DOCUMENTS

| | | |
|---|---|---|
| PCT/US96/06799 | 12/1996 | WIPO . |

*Primary Examiner*—Huan Tran
*Attorney, Agent, or Firm*—Salter & Michaelson

[57] ABSTRACT

An apparatus for applying images to opposite first and second sides of a continuous strip includes a back plate, and first, second, and third printing stations each being cooperatively actuatable for applying first, second, and third images to a continuous strip. The first, second, and third printing stations have a predetermined equal distance therebetween. The third printing station is positioned at a slightly higher elevation on the back plate than the second printing station and the second printing station is positioned at a slightly higher elevation on the back plate than the first printing station. The apparatus further includes first and second guide rollers, the first guide roller being positioned between the first and second printing stations adjacent the first printing station along a horizontal plane substantially parallel to the first printing station, and the second guide roller being positioned between the second and third printing stations adjacent the second printing station along a horizontal plane substantially parallel to the second printing station. A drive assembly having a rotatable drive roller longitudinally advances the strip so that it passes through the first, second, and third printing stations. Further embodiments of the apparatus are also contemplated.

25 Claims, 13 Drawing Sheets

TWO-SIDED COLOR PRINTING APPARATUS

BACKGROUND OF THE INVENTION

The instant invention relates to apparatus for printing on a continuous strip, and more particularly to a two-sided printing apparatus which is capable of printing in multiple colors on two sides of a continuous strip, and which is easy to disassemble for maintenance purposes and for replacement of worn parts.

Thermal printing apparatus, and more specifically, two-sided thermal printing apparatus, have heretofore been known in the art. In this regard, U.S. Pat. No. 4,811,036 to Gaskill et al. and application Ser. No. 08/461,392, filed Jun. 5, 1995, entitled TWO-SIDED COLOR PRINTING APPARATUS AND REVERSIBLE PRINT HEAD MOUNTING ASSEMBLY THEREFOR, now U.S. Pat. No. 5,675,369, represent the closest prior art to the subject invention of which the applicant is aware. The '036 patent to Gaskill discloses a printing apparatus operative for applying images to opposite sides of a continuous strip at first and second sequential printing stations. The first printing station is operative for applying a single color image (usually black) to the lower side of the strip, and the second printing station is operative for applying a single color image to the upper side of the strip. The apparatus further includes a feed assembly driven by a stepping motor for advancing the continuous strip from the first printing station to the second printing station and a controller responsive to a predetermined number of stepped rotational increments of the stepping motor for coordinating the printing operations at the first and second printing stations. While the above-described apparatus is effective for applying single color images to each of the opposite surfaces of the strip, the apparatus is not capable of printing multiple-color images on either side of the strip.

The apparatus disclosed in the above-noted application solves many of the aforementioned problems. The apparatus is operable for applying images to opposite first and second sides of a continuous strip, and includes first, second, third and fourth thermal printing assemblies actuatable for applying first, second, third and fourth images to the continuous strip at first, second, third and fourth printing stations, respectively. The first and third thermal printing assemblies are mounted on reversible mounting assembles capable of mounting the respective thermal printing assembly in a first position wherein the printing assembly is actuatable for applying an image to a first side of the strip, and a second position wherein the printing assembly is actuatable for applying an image to a second side of a strip. The apparatus further includes a drive assembly including a rotatable drive roller for longitudinally advancing the strip so that it passes through the printing assemblies, a stepping motor rotatable at a predetermined fixed rate of stepped rotational increments per revolution for rotating the drive roller to advance said strip, and a controller responsive to a predetermined number of stepped rotational increments of the stepping motor corresponding to a predetermined distance between the printing assemblies for actuating the printing assemblies to apply images to the first and second sides of the strip. The stepping motor and controller ensure proper longitudinal alignment of the printed images on the first and second sides of the strip.

While this apparatus is also suitable for its intended purpose, it is somewhat difficult to disassemble for conducting routine maintenance and for replacing worn parts. The present invention is designed for overcoming this limitation of the prior art apparatus.

BRIEF SUMMARY OF THE INVENTION

In general, the instant invention provides an apparatus for applying images to opposite first and second sides of a continuous strip comprising a back plate, and first, second, and third printing means each being cooperatively actuatable for applying first, second, and third images to a continuous strip at first, second, and third printing stations. The first, second, and third printing stations have a predetermined equal distance therebetween wherein the third printing station is positioned at a slightly higher elevation on the back plate than the second printing station and the second printing station is positioned at a slightly higher elevation on the back plate than the first printing station. The apparatus further comprises first and second guide rollers, the first guide roller being positioned between the first and second printing stations adjacent the first printing station along a horizontal plane substantially parallel to the first printing station, and the second guide roller being positioned between the second and third printing stations adjacent the second printing station along a horizontal plane substantially parallel to the second printing station. Drive means comprising a rotatable drive roller longitudinally advances the strip so that it passes through the first, second, and third printing means.

In a second aspect of the present invention, each printing station comprises a thermal printing assembly including a print head pivoting mechanism having a pivotable arm with a thermal print head mounted thereon. The pivotable arm is pivotable between an operating position and a non-operating position. A pivotable cam is also pivotable between a first position in which it engages the arm when the arm is in its operating position and a second position in which it is pivoted away from the arm. The printing station further comprises a platen assembly including a rotatable platen roller and a platen roller mechanism. The arrangement is such that thermal print head of the pivotable arm is closely adjacent the platen roller when the arm is in its operating position.

In a third aspect of the present invention, each printing station comprises a thermal printing assembly as set forth above and a platen assembly including a rotatable platen roller and a platen roller mechanism having a roller shaft mounted on the back plate and a roller bracket axially and releasably mounted on the roller shaft. The roller bracket is adapted to releasably receive the platen roller.

In a fourth aspect of the present invention, the apparatus comprises a back plate and at least one printing means mounted on the back plate for applying an image to a continuous strip at a printing station. Each printing station comprises a thermal printing assembly including a print head pivoting mechanism having a pivotable arm with a thermal print head mounted thereon. The pivotable arm is pivotable between an operating position and a non-operating position. A platen assembly includes a rotatable platen roller and a platen roller mechanism. The thermal print head of the pivotable arm is closely adjacent the platen roller when the arm is in its operating position. Drive means of the instant invention includes a rotatable drive roller mounted in rotating fashion on the back plate for longitudinally advancing the strip so that it passes through the printing means. The apparatus further comprises sensor means including a plate mounted on the back plate, a sensor assembly having a bracket received within an opening formed in the plate and a pair of members which are axially slidable on the bracket, and a sensor indicator mounted on the housing. The removal and replacement of the sensor indicator is achieved by axially sliding off the members for revealing the sensor indicator.

In a fifth aspect of the present invention, the drive means comprises a drive assembly having a drive roller, and a cantilevered arm having one end mounted on the back plate. The cantilevered arm has a support plate releasably secured to an opposite end thereof, and a rotatable pressure roller having one end mounted in rotating fashion on the back plate and an opposite end mounted in rotating fashion on the support plate.

Accordingly, among the objects of the instant invention are: the provision of a printing apparatus for applying a multiple-color image to one side of a continuous strip while also applying at least a single color image to a second side of the strip; the provision of a printing apparatus having multiple reversible print heads for printing on either of two opposite sides of a continuous strip; the provision of a printing apparatus having component parts which are easily disassembled for conducting routine maintenance and for replacing worn parts; the provision of a printing apparatus which enables routine maintenance and replacement of worn parts to be carried out without affecting the registration and alignment of print stations of the apparatus; the provision of a printing apparatus which produces a high quality print image on print media; and the provision of a printing apparatus in which the print media can be easily aligned to the print head thereof.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
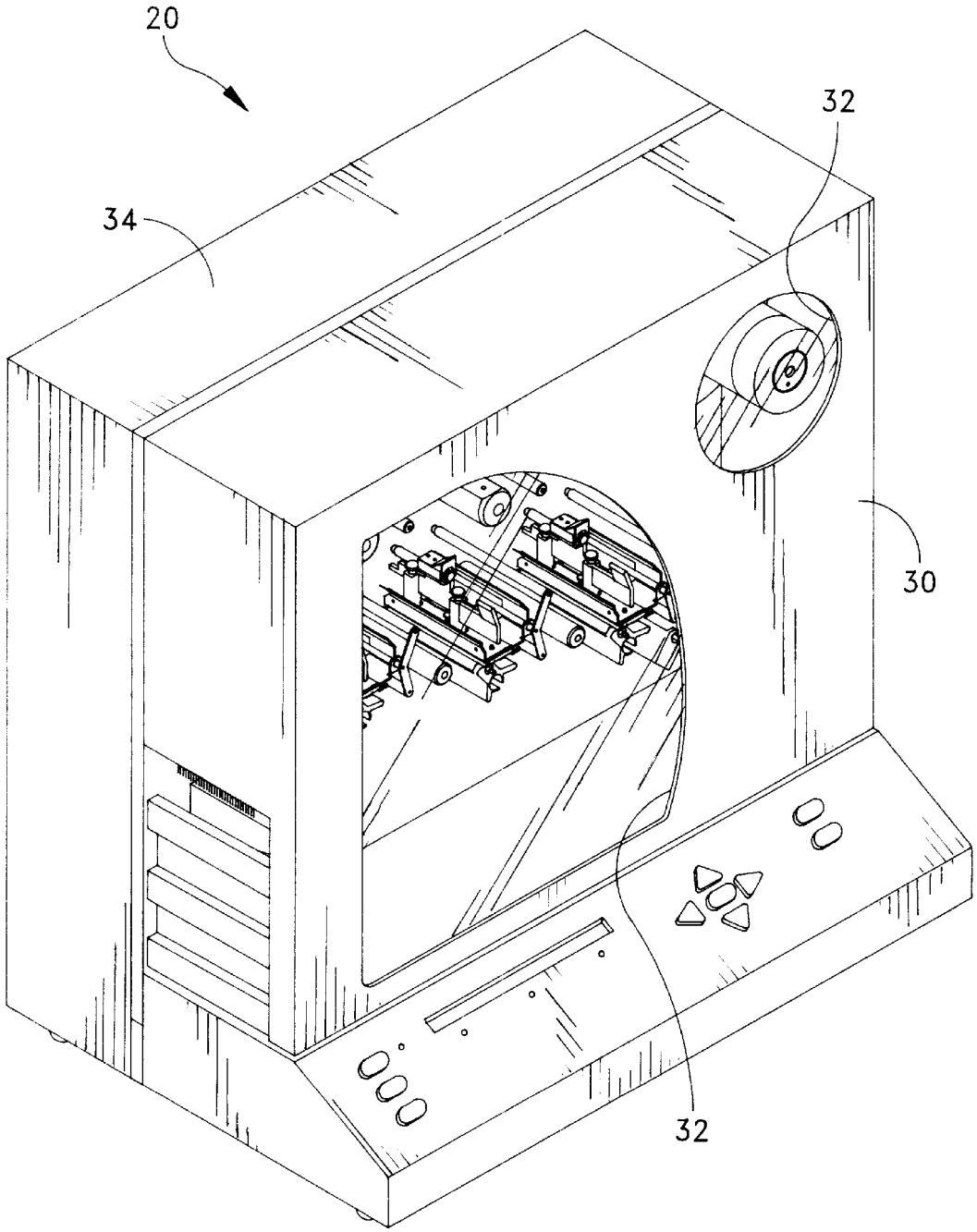
FIG. 1 is a perspective view of a thermal printing apparatus of the instant invention.
Figure 2:
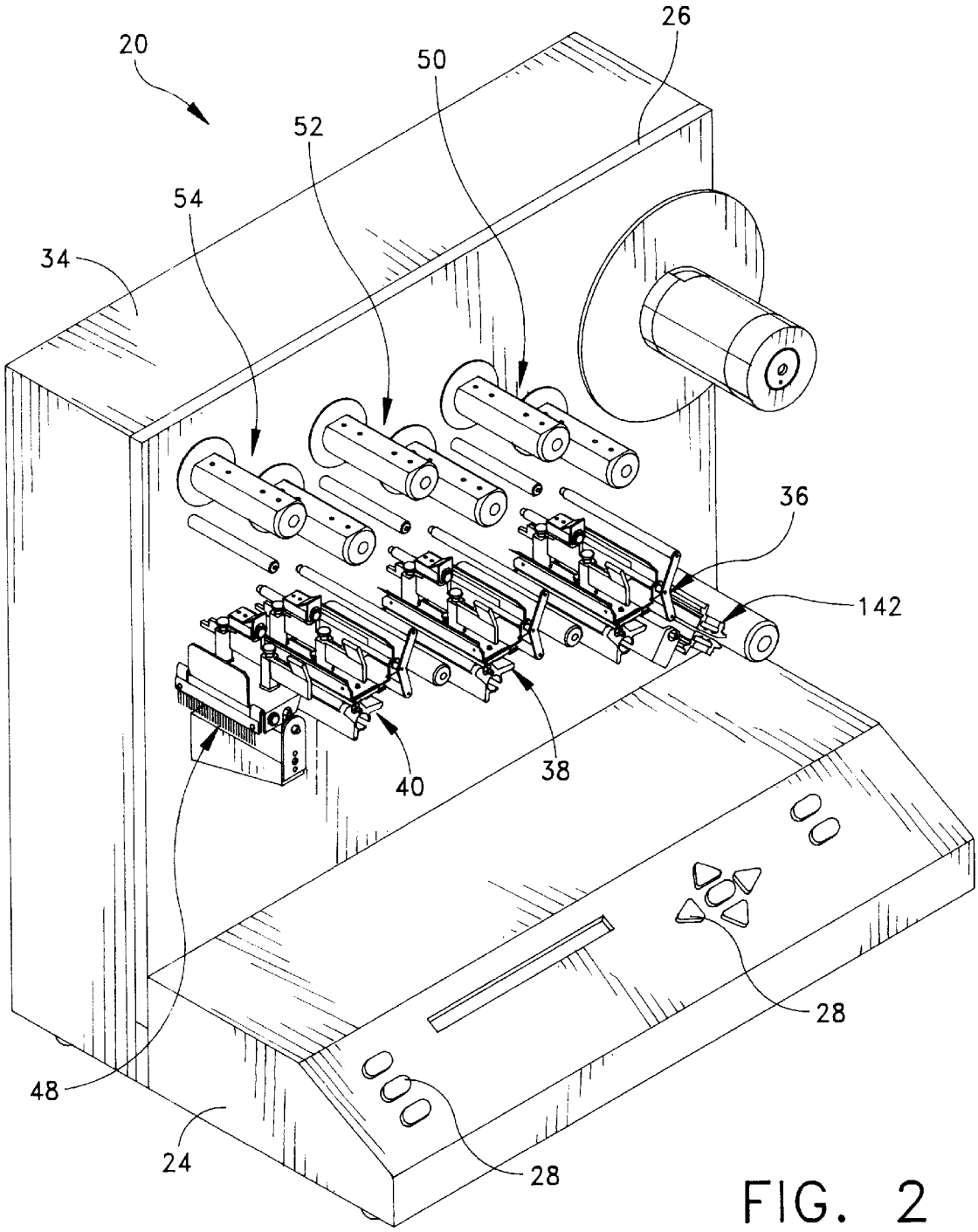
FIG. 2 is a perspective view of the thermal printing apparatus illustrated in FIG. 1 with a cover of the thermal printing apparatus removed therefrom.

Referring now to the drawings, and more particularly to FIGS. 1 and 2, there is generally indicated at 20 a thermal printing apparatus of the present invention. As will hereinafter be more fully described, the instant thermal printing apparatus 20 is operable for printing multiple thermal images of different colors onto the opposite first and second sides of a continuous strip 22 of print media (see FIGS. 3 and 4). In addition, the apparatus 20 is easy to disassemble for conducting routine maintenance and for replacing worn parts.

The apparatus 20 includes a base 24 and a back plate 26. The base 24 has a plurality of control elements 28 (e.g., push buttons) provided thereon for controlling the operation of the apparatus 20. A front cover 30 (see FIG. 1) is releasably attachable to the base 24 and the back plate 26 by any suitable manner for concealing the components of the apparatus 20. As shown in FIG. 1, the cover 30 includes two windows 32 for viewing the operation of the various components of the apparatus 20 and for enabling the operator to identify when stock items need replacement. A rear cover 34 is further provided for covering the components mounted on the backside of the back plate 26, and is also secured thereto in any suitable fashion.

Figure 3:
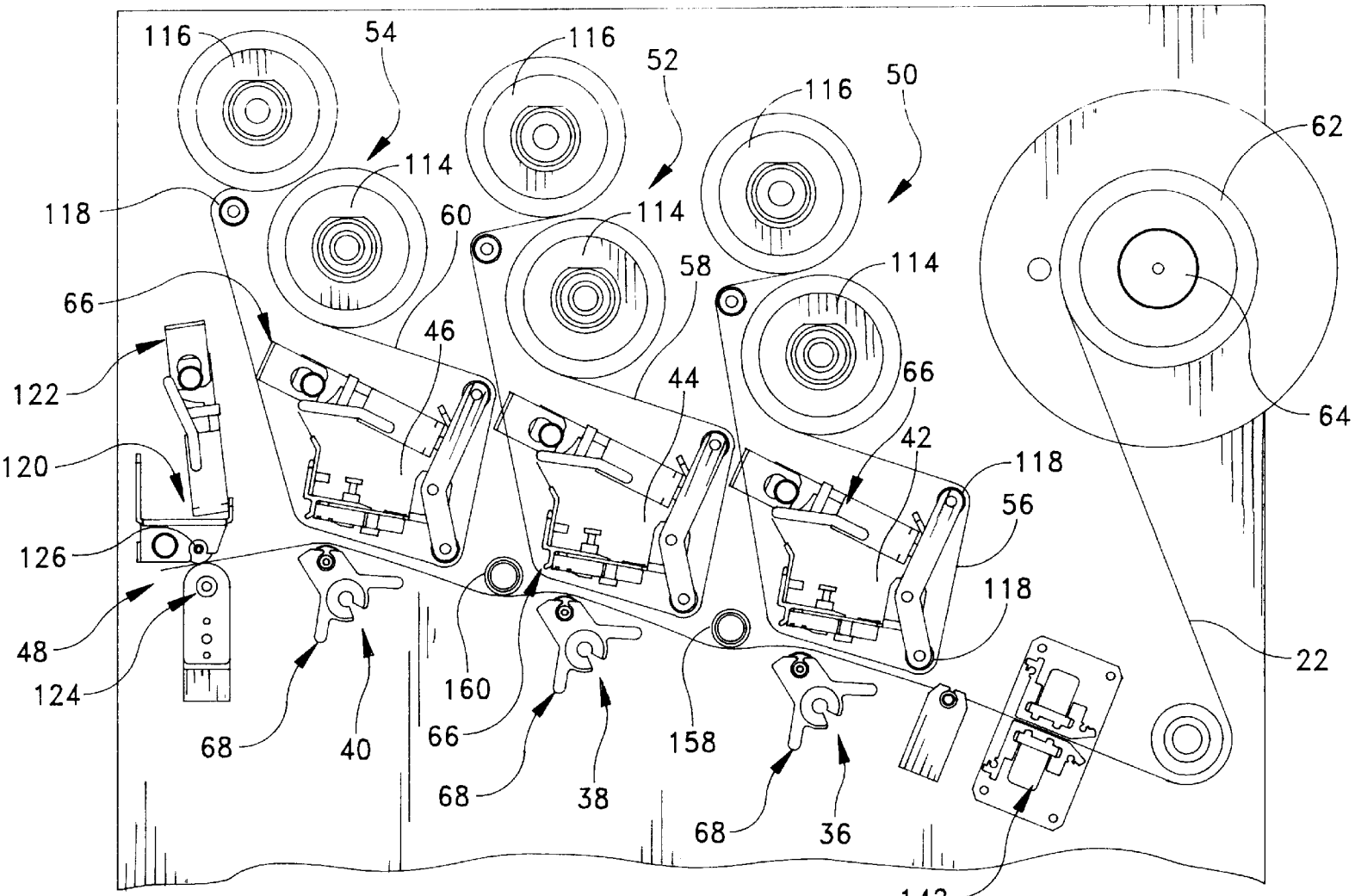
FIG. 3 is a fragmentary front elevational view of the apparatus.
Figure 4:
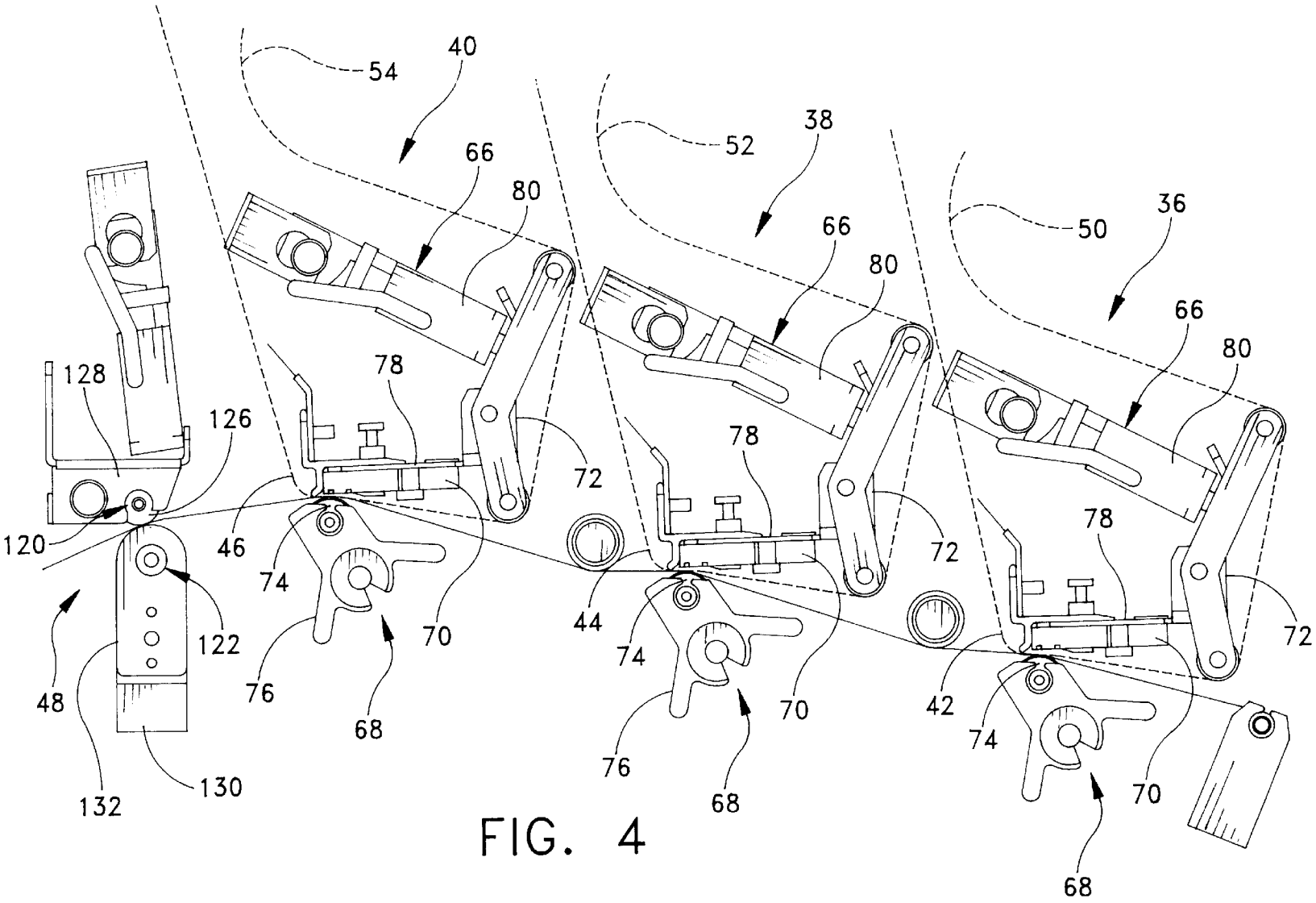
FIG. 4 is an enlarged fragmentary front elevational view of the apparatus as illustrated in FIG. 3.

Turning now to FIGS. 2–4, the apparatus 20 comprises first, second, and third printing assemblies generally indicated at 36, 38, and 40, respectively, the printing assemblies being operable at first, second, and third printing stations 42, 44, and 46, respectively, for printing first, second, and third images onto the strip. A feed assembly generally indicated at 48, is provided for drawing the strip 22 through the printing stations 42, 44, and 46. The apparatus 20 further includes a motor (not shown), first, second, and third printing film drive assemblies generally indicated at 50, 52, and 54, respectively, and a controller (not shown). The controller is in electrical communication with the control elements 28 provided on the base 24 for operating the apparatus 20.

During operation of the apparatus 20, the printing film drive assemblies 50, 52, and 54 are operated to supply first, second, and third printing films 56, 58, and 60, respectively, to the printing stations 42, 44, and 46, and the motor is operated to advance the strip 22 in a substantially taught disposition between the printing stations. The controller is responsive to a predetermined number of stepped rotational increments of the motor (preferably a stepping motor) for controlling the printing assemblies 36, 38, and 40 to apply images to the opposite sides of the strip 22 so that the longitudinal positions of the images are precisely coordinated throughout the longitudinal extent of the strip. This general arrangement is disclosed in the above-mentioned patent application.

It should be understood that the provision of more than three printing assemblies 36, 38, and 40 is contemplated herein and within the scope of the instant invention. In addition, one or two printing assemblies can also be utilized pursuant to the teachings of the instant invention as well.

The strip 22 preferably comprises a continuous strip of a paper or non-woven substrate having a width of between 1" and 4⅝". The strip 22 is preferably provided in a continuous roll 62 (FIGS. 3 and 4) which is received over a cylindrical shaft 64 mounted on the back plate 26.

Figure 5:
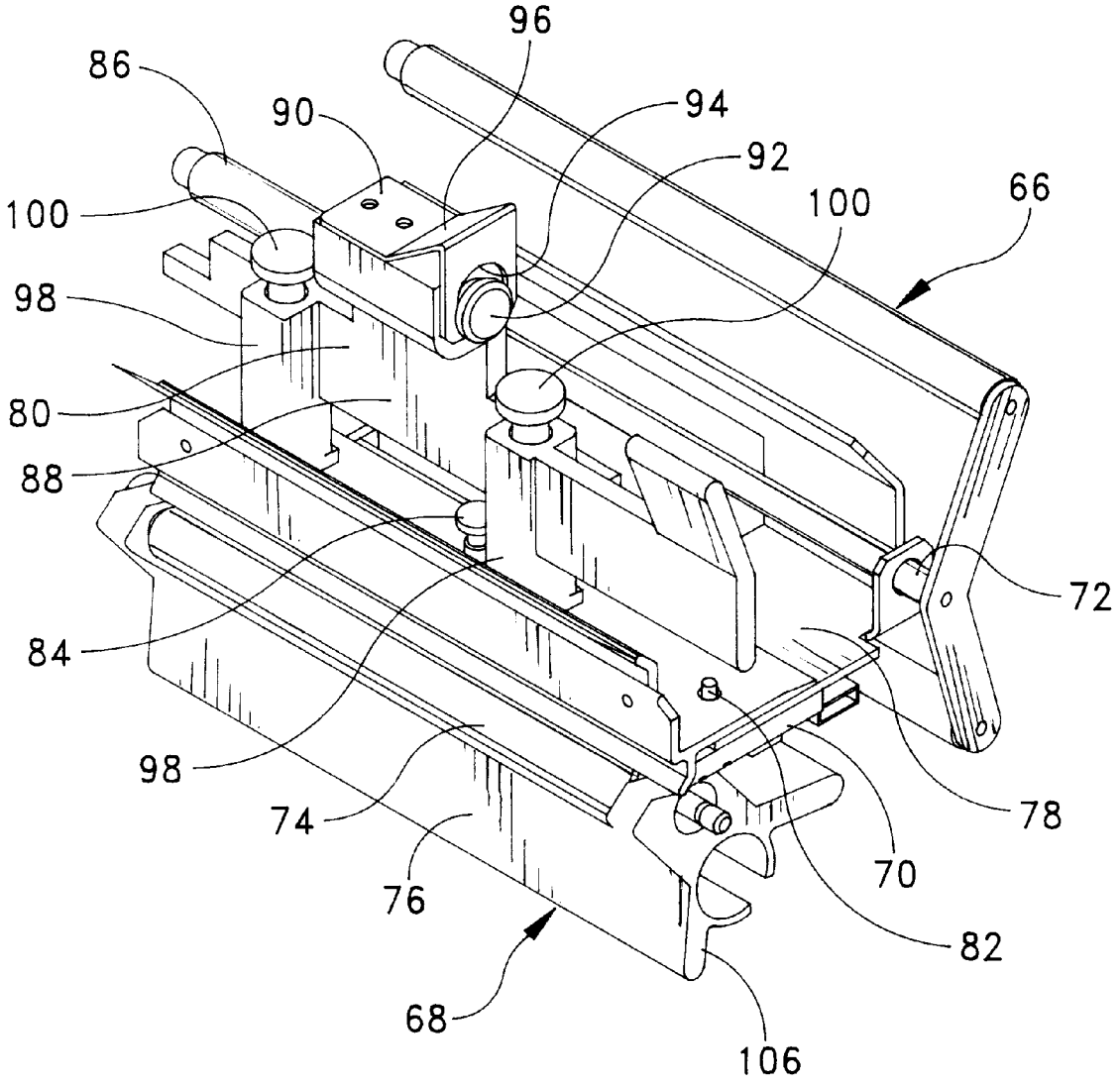
FIG. 5 is an even further enlarged perspective view of a thermal printing assembly of the thermal printing apparatus.

Referring now to FIGS. 3–5, a printing station of one of the printing assemblies is more clearly illustrated. Each printing station 43, 44, and 46 is constructed identically to the other printing station, and comprises a thermal printing subassembly generally indicated at 66, which cooperates with a platen assembly generally indicated at 68. The thermal printing subassembly 66 includes a thermal print head 70 and a print head pivoting mechanism 72. The print head 70 preferably comprises a conventional thermal print head having an array of discretely energizable thermal elements. Energizing of the thermal elements is controlled by the controller through conventional cable means (not shown). The platen assembly 68 includes a cylindrical platen roller 74 having a rubberized outer shell, and a platen roller mechanism 76 which is operative for rotatably receiving the platen roller 74 in parallel relation to the thermal print head 70.

Figure 8:
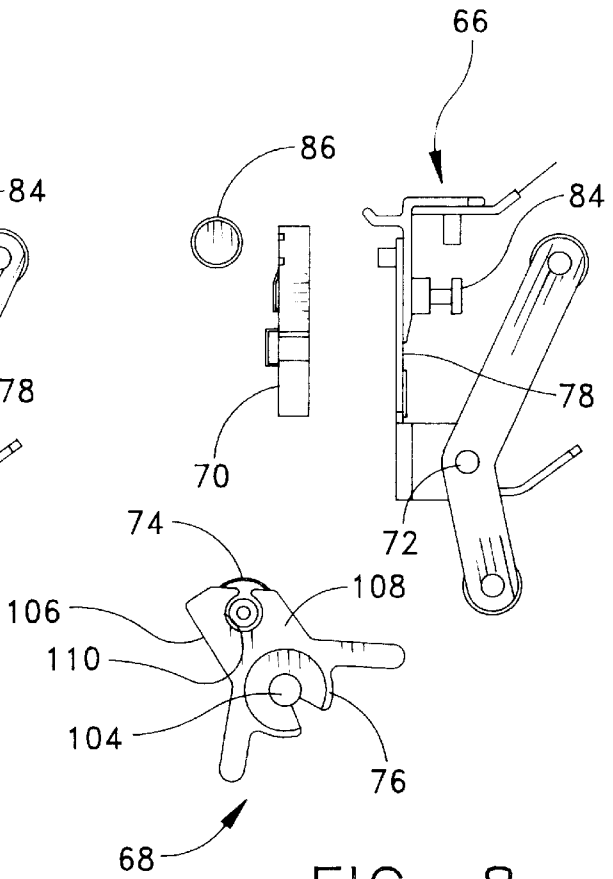
FIG. 8 is a front elevational view of the thermal printing assembly similar to FIGS. 6 and 7 illustrating the print head being removed from a print head arm mechanism.
Figure 7:
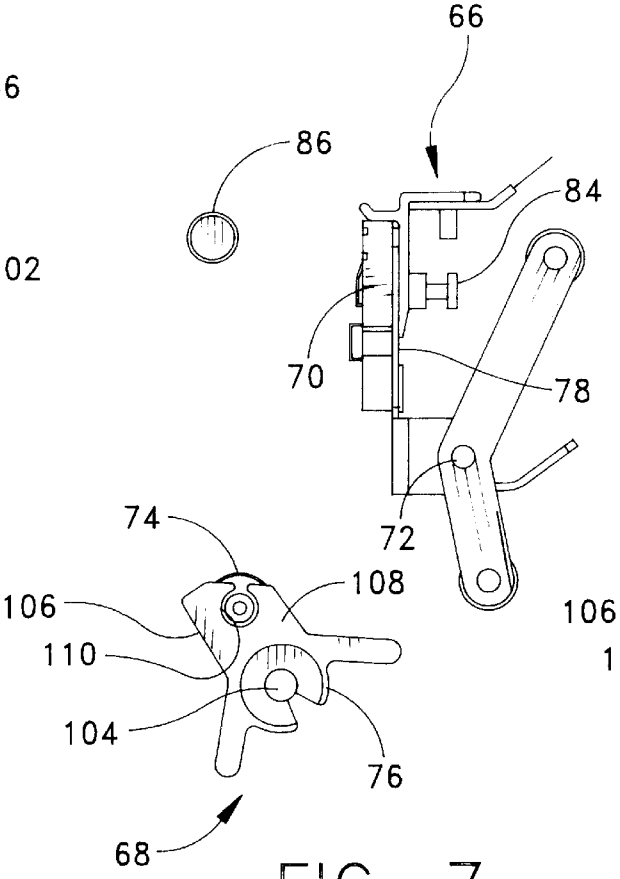
FIG. 7 is a front elevational view of the thermal printing assembly similar to FIG. 6 illustrating the print head pressure cam completely removed from the assembly and the print head rotated completely away from the platen roller.
Figure 6:
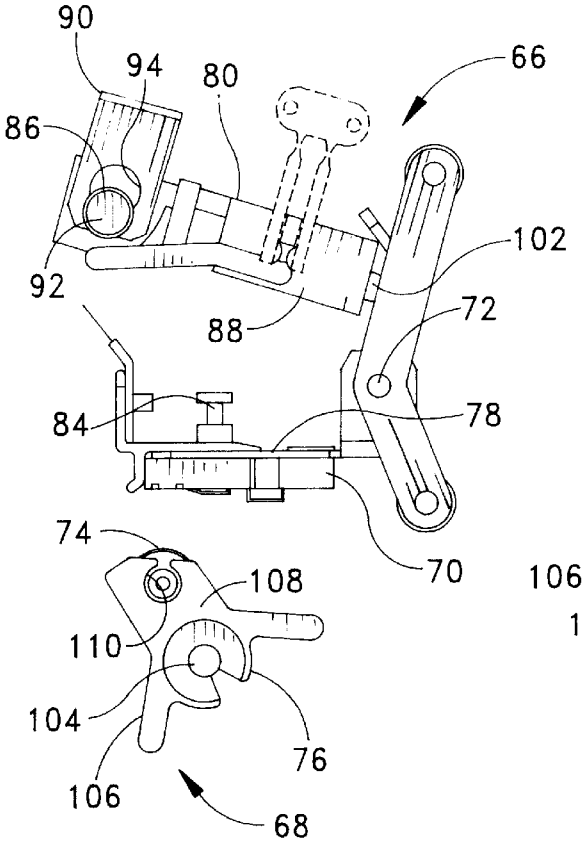
FIG. 6 is a fragmentary front elevational view of the thermal printing assembly illustrating a print head pressure cam of the thermal printing assembly in a disengaged position and a print head rotated away from a platen roller of the thermal printing assembly.
Figure 6A:
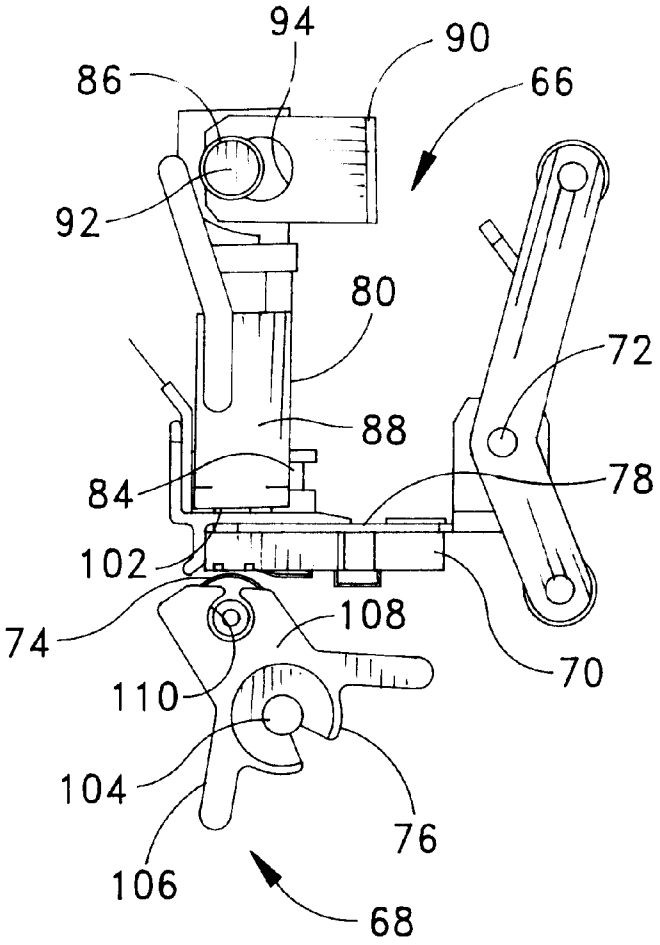
FIG. 6A is a fragmentary front elevational view of the thermal printing assembly illustrating the print head pressure cam in an engaged position.

Turning now to FIGS. 6–8, the print head pivoting mechanism 72 is operative for mounting the thermal print head 70 in substantially parallel relation to the platen roller 76 so that it is movable between an operating position (FIG. 6) wherein the thermal print head is positioned in biased engagement with the platen roller, and an non-operating position (FIGS. 7 and 8) wherein the thermal print head is lifted out of engagement with the platen and away from the platen assembly. The print head pivoting mechanism 72 comprises a pivotable arm 78 having the thermal print head 70 mounted thereon and a print head pressure cam 80 for engaging and biasing the pivotable arm 78. The pivotable arm 78 is secured to the back plate 26 in any suitable manner which achieves the pivoting motion described above. The thermal print head 70 includes at least one detent member 82 (see FIG. 5) which is received within a corresponding recess (not designated) formed in the pivotable arm 78. A thumb screw fastener 84 releasably secures the thermal print head 70 to the pivotable arm 78, this construction enabling the easy removal of the thermal print head from the pivotable arm for cleaning and/or replacement.

As shown in FIGS. 4–8, the pivotable arm 78 of the print head pivoting mechanism is pivotable between the aforementioned operating position (illustrated in FIGS. 4 and 5) in which the cam 80 engages and biases the pivotable arm for moving the thermal print head 70 towards the platen roller 74, an intermediate operating position (illustrated in FIG. 6) in which the cam is pivoted away from the pivotable arm, and the non-operating position (illustrated in FIGS. 7 and 8). A spring or similar component (not shown) provides a biasing force for moving the pivotable arm away from the platen roller when the arm is in its intermediate operating position.

Referring particularly to FIGS. 5 and 6, the print head pressure cam 80 is releasably mounted on the back plate 26, and comprises a cam shaft 86 fixedly mounted on the back plate, a main body 88 axially and releasably mounted on the cam shaft, and an L-shaped spring clip 90 mounted on the main body for releasably attaching the main body to the cam shaft. Specifically, the spring clip 90 is engageable with an end portion 92 of the cam shaft having an annular recess (not designated) formed therein. The spring clip 90 has an opening 94 defined by an edge, the edge being disposed within the annular recess for maintaining the main body 88 and the cam shaft 86 in assembled relation. The spring clip 90 design enables the easy removal and attachment of the cam 80 on the cam shaft 86 by merely pushing a leg 96 of the spring clip downwardly for disengaging the spring clip from the cam shaft 86 and axially sliding the main body 88 off the cam shaft.

The main body 88 of the cam 80 has a bore (not designated) formed therein through which the cam shaft 86 is received when mounting the main body on the cam shaft. A pair of engagement elements, each indicated at 98, are secured to the main body 88 and are positioned for engagement with the pivotable arm 78. As shown in FIG. 5, the engagement elements 98 each comprise a thumb turn member 100 having a knob and a threaded bolt which is threadably secured within a threaded bore (not shown) formed in the main body 88 in a direction perpendicular to the direction of the bore receiving the cam shaft 86. The threaded bolt of the thumb turn member 100 has an end portion 102 (see FIG. 6) which engages the pivotable arm 78. By turning the thumb turn member 100, the force of engagement of the cam 80 against the pivotable arm 78 can be adjusted. Thus, the space between the thermal print head 70 and the platen roller 74 can be adjusted by simply rotating the thumb turn members 100 of the cam 80 when the cam is engaging the pivotable arm 78.

It should be observed that upon removing the cam 80 and pivoting the pivotable arm 78 to its non-operating position the operator can easily insert his or her hand within the space created by the removed cam for cleaning the thermal print head 70. This design also allows for the thermal print head 70 to be completely removed without disrupting the position of the print line relative to the optimum printing position. The thermal print head 70 is removed without disassembling any of the parts that hold it in place. It should be noted that the cam 80 is held in place by a clamping mechanism (not shown) provided on the back side of the back plate 26. The clamping mechanism holds the cam 80 in its position away from the pivotable arm 78 and by applying a nominal rotating force thereto in a clockwise direction the cam can be removed from the clamping mechanism.

Figure 9:
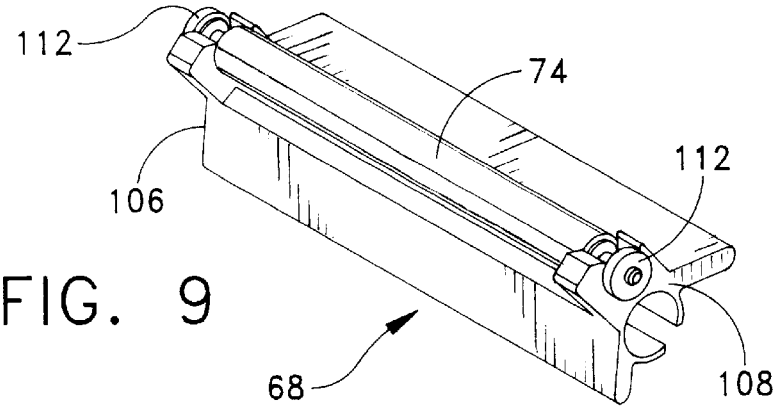
FIG. 9 is an enlarged perspective view of the platen roller of the thermal printing assembly.
Figure 10:
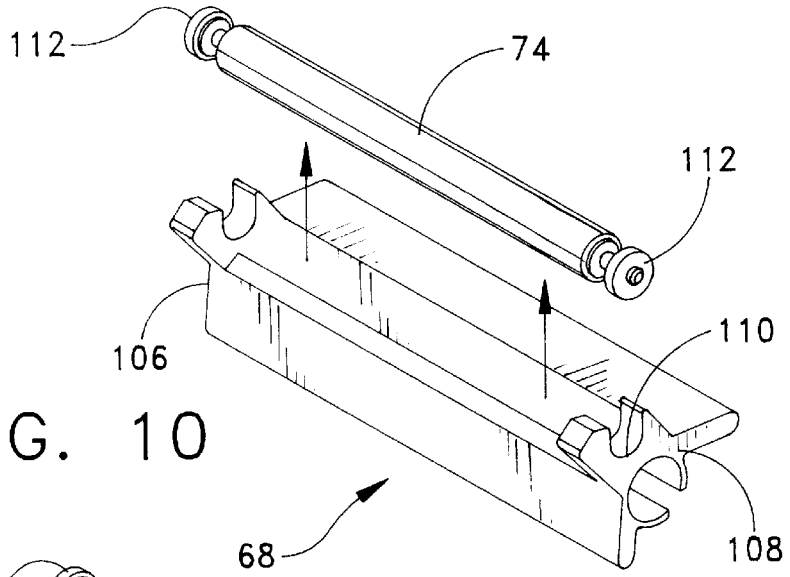
FIG. 10 is a perspective view of the platen roller being removed from a bracket adapted to secure the platen roller.
Figure 11:
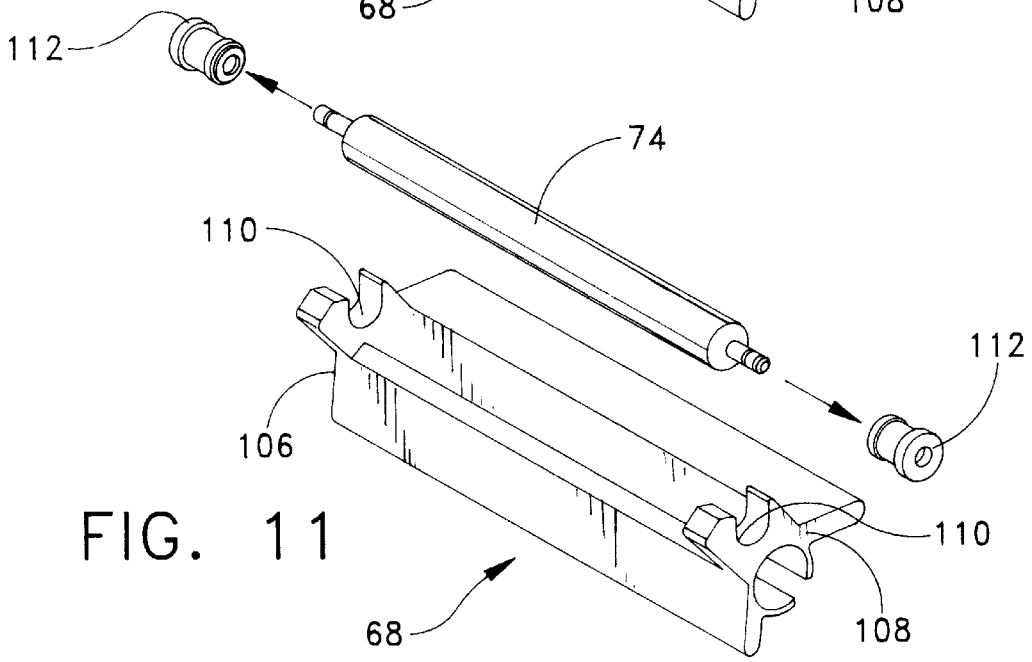
FIG. 11 is a perspective view of the platen roller illustrating bearings being removed therefrom.

Referring to FIGS. 9–11, the platen assembly 68 is illustrated apart from the remaining components of the printing station 42, 44, or 46 in order to view the ease of replacement of the platen roller 74. Given the amount of pressure applied on the platen roller 74 from the print media 22 and the thermal print head 70, the platen roller is subject to excessive wear. Inconsistencies on the rubberized outer shell of the platen roller 74 causes inaccurate printing on the print media 22. Thus, since the platen rollers 74 must be replaced frequently, it is important that they are easily disassembled from the printing station 42, 44, or 46 and accessible to the operator conducting the maintenance.

When the pivotable arm 78 is in its non-operating position, the platen roller 74 is accessible. At this point, the platen roller 74 can be completely removed from the platen roller mechanism 76. As shown, the platen roller mechanism 76 includes a roller shaft 104 (see FIGS. 6–8) which is mounted on the back plate 26, and a roller bracket 106 which is axially and releasably mounted on the roller shaft. The roller bracket 106 is constructed to releasably receive the platen roller 74 and rotatable about the roller shaft 104 for adjusting the location of the platen roller. More specifically, the roller bracket 106 has a body 108 with an axial bore (not designated) for receiving the roller shaft 104 and a pair of spaced apart receiving cutouts 110 formed within the body for receiving opposite ends of the platen roller 74. These cutouts 110 receive bearings 112 provided on opposite ends of the platen roller 74.

As shown in FIGS. 3–5, 6–8 and 16, the cutouts can be formed for capturing the bearings 112. However, as shown in FIGS. 9–11, the cutouts can be formed to allow the bearings 112 to be easily removed from the roller bracket 106. It should be noted that the platen roller 74 does not need to be positively secured to the roller bracket 106 since gravity maintains the platen roller in place. However, when printing on the underside of the print media 22, the roller bracket 106 must be configured in the manner depicted in FIGS. 3–5, 6–8 and 16 to capture the platen roller 74 in assembled relation with the roller bracket 106.

As mentioned briefly above, it should be noted that the platen roller 74 can be easily adjusted by pivoting the roller bracket 106 about the roller shaft 104. Prior art apparatus adjusted for print quality by moving the thermal print head in relation to the platen roller. By pivoting the roller bracket 106 to adjust the spacing between the thermal print head 70 and the platen roller 74, print quality can be optimized without having to adjust the fixed thermal print head. This increases reliability in registration when the print head 70 or platen roller 74 need replacement.

The first, second, and third printing film drive assemblies 50, 52, and 54 are operative for advancing their respective printing films 56, 58, and 60 through the respective printing stations 42, 44, and 46 so that the printing films pass between the respective print head 70 and the strip 22. The printing films 56, 58, and 60 each comprise conventional thin polyester films having heat sensitive coatings thereon, and they are responsive to heat from the thermal print heads 70 for transferring selected portions of the coatings thereon onto the strip 22 to apply images to the strip. The printing films 56, 58, and 60 each preferably have a width of about 1" to 4 ⅝". The film drive assemblies 50, 52, and 54 each comprise a film supply hub 114 containing a supply of film, and a film take-up hub 116 and several guide rolls 118 for guiding the films 56, 58, and 60 into proper alignment into the printing station.

Each supply hub 114 is rotatably mounted to the back plate 26 and includes a resistance mechanism (not shown) for applying a slight resistance to rotation of the hub 114 in order to maintain the film 56, 58, or 60 in a substantially taught condition as it is passed through its respective print station. Each take-up hub 116 is also rotatably mounted to the back plate 26 and drivingly coupled its respective drive motor (not shown) through a conventional slip clutch mechanism (not shown). During operation of the apparatus 20, the drive motors are operated to rotate the take-up hubs 116 in order to advance the films 56, 58, or 60 through the printing stations 42, 44, or 46. However, the slip clutches are designed so that they increasingly slip as the wound diameters of the take-up hubs 116 are increased in order to maintain substantially constant film speeds throughout the printing processes.

Figure 12:
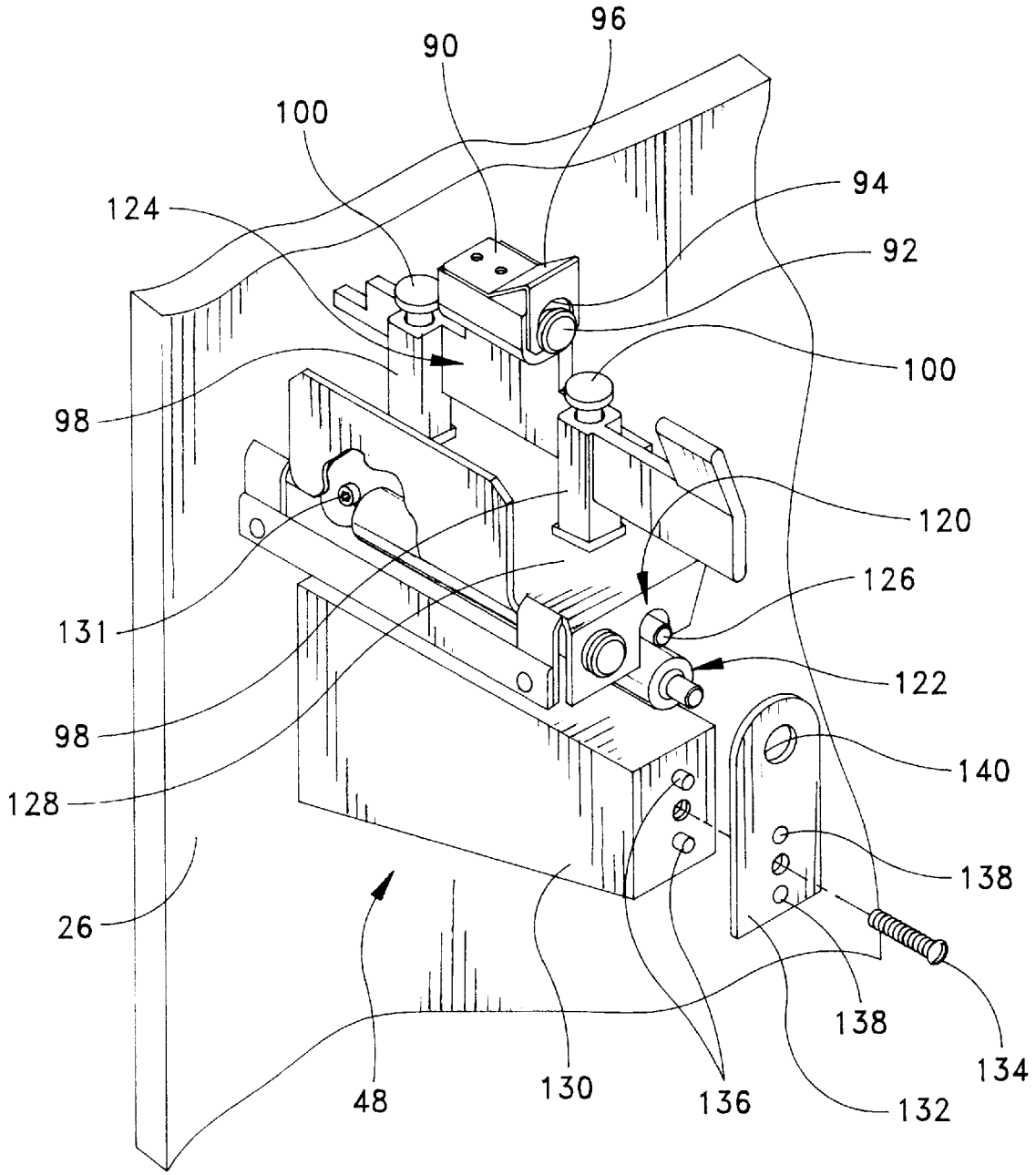
FIG. 12 is an enlarged perspective view of a drive roll assembly of the apparatus.
Figure 13:
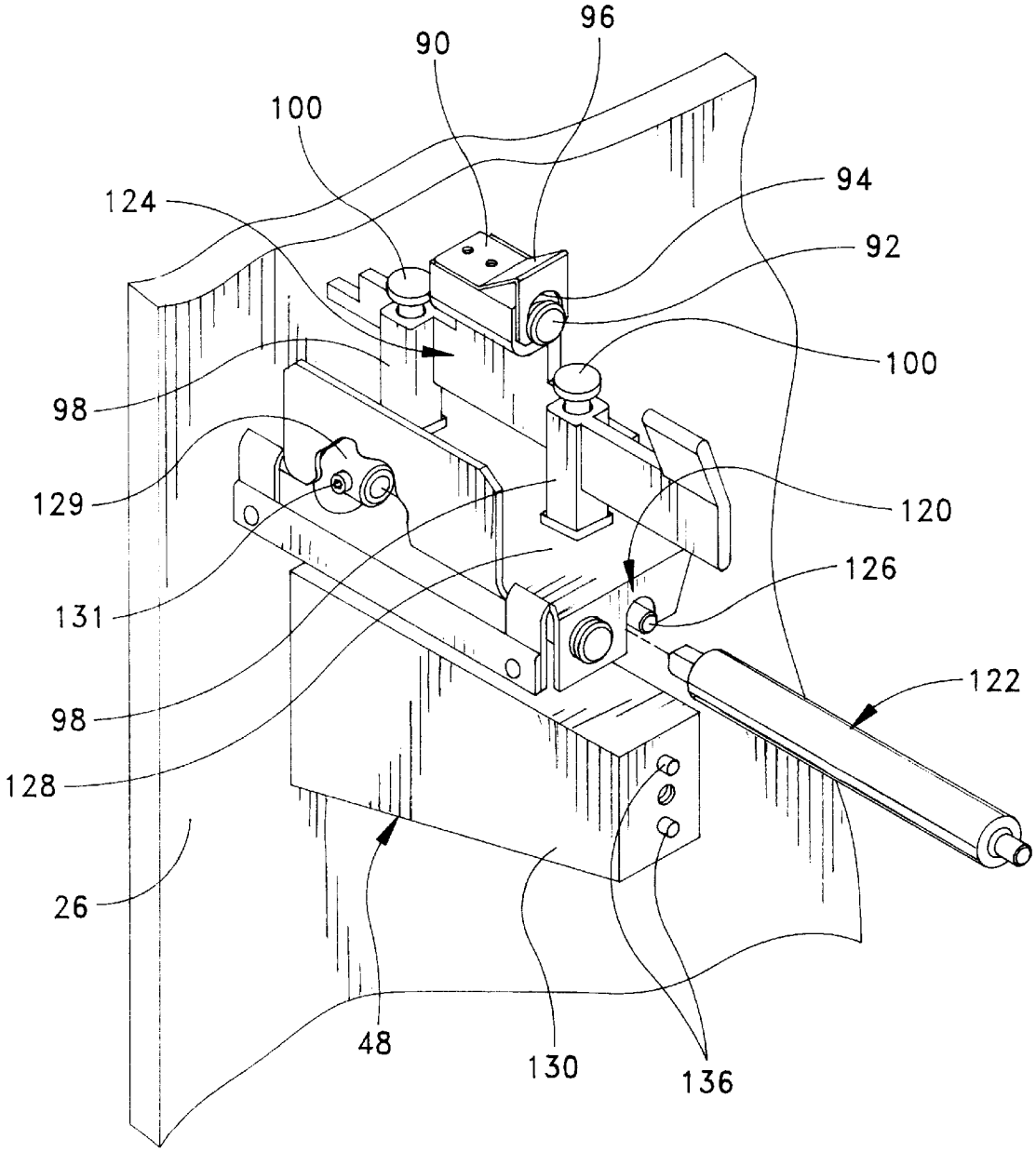
FIG. 13 is an enlarged perspective view of the drive roll assembly as illustrated in FIG. 12 with a drive roll thereof removed from the drive roll assembly.

Referring now to FIGS. 12 and 13, the feed assembly 48 is operative for advancing the strip 22 through the apparatus 20 so that it passes through the first, second, and third printing stations 42, 44, and 46. More specifically, the feed assembly 48 comprises a pressure assembly generally indicated at 120, a rubber coated, drive roller generally indicated at 122, and a toggle element generally indicated at 124, for urging a steel idler shaft 126 of the pressure assembly 120 into pressured engagement with the drive roller 122. The toggle element 124 is constructed similarly to the cam 80 described above wherein corresponding reference numerals designate corresponding parts between the several views of the drawings. The steel idler shaft 126 is supported by a mounting bracket 128 for mounting the steel idler shaft to the back plate 26. Similarly, the drive roller 122 is rotatably mounted at its outer end on a cantilevered arm 130 which is mounted on the back plate 26. The other end of the drive roller 122 is driven by a suitable drive mechanism 129 and is held in place by a set screw 131 (see FIG. 13).

More particularly, a support plate 132 is releasably secured (see FIG. 12) by a threaded fastener 134 to the outer end of the cantilevered arm 130 within a threaded opening (not designated) for supporting the outer end of the drive roller 122. A pair of detents each indicated at 136 projecting outwardly from the other end of the cantilevered arm 130 are received through small apertures 138 formed in the support plate 132 for aligning the support plate on the cantilevered arm. The support plate 132 has a larger opening 140 formed therein through which the other end of the drive roller 122 is received. This construction enables the operator of the apparatus 20 to easily remove the support plate 132 by unscrewing fastener 134 (FIG. 12) and completely removing the drive roller 122 (FIG. 13). The drive roller 122, much like the platen rollers 74 of the printing stations 42, 44, and 46, is subject to excessive wear and tear and thus is subject to frequent replacement.

It should also be observed that the stepping motor is drivingly coupled to the drive roller 122 via a drive belt (not shown) and pulleys (also not shown) attached to the stepping motor and drive roller. The stepping motor is operative at a uniform rate of stepped rotational increments per revolution in order to insure precise longitudinal orientation of the different images applied to opposite sides of the strip 22 at the printing stations 42, 44, and 46. It should be understood that the apparatus 20 of the instant invention does not require a stepper motor as set forth above.

The controller is operable in a conventional manner and includes a programmable microprocessor which can be programmed for control of the stepping motor, the thermal print heads 70, and the printing film drive assemblies 50, 52, and 54. More specifically, the controller is programmed so that it is responsive to a predetermined number of stepped rotational increments of the stepping motor for coordinating the energizing of the thermal print heads 70 in the printing assemblies 36, 38, and 40. The controller actuates the first printing assembly 36 to apply a first image to the strip 22 at the first printing station 42, and then for actuating the second printing assembly 38 for applying an image to the strip 22 at the second printing station 44 after a predetermined number of stepped rotational increments of the stepping motor which corresponds to the distance between the two printing stations 42, 44. The controller further controls the third printing assembly 40 for similarly applying a third image to the strip 22. In other words, the controller sequentially coordinates the longitudinal positions of the images on the strip 22. The controller is also operative for controlling the printing film drive assemblies 50, 52, and 54 so that the films 56, 58, and 60, respectively, are passed through the printing stations 42, 44, and 46 as the strip 22 is advanced.

Figure 14:
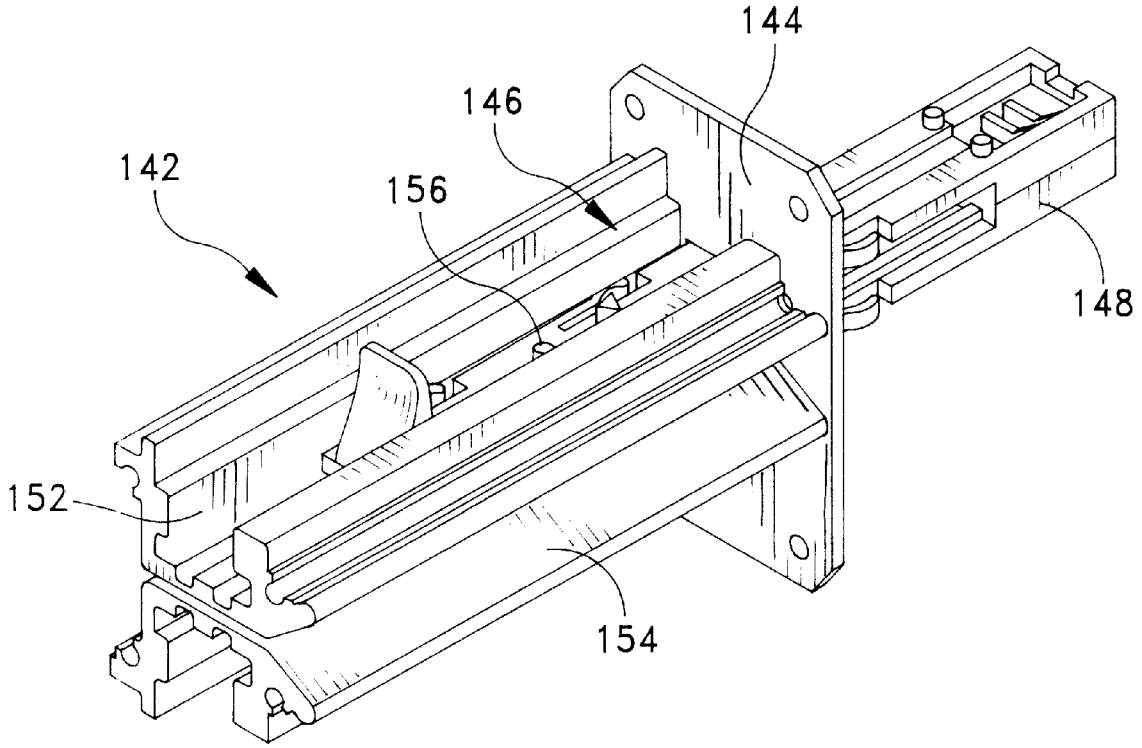
FIG. 14 is a perspective view of a sensor of the thermal printing apparatus.
Figure 15:
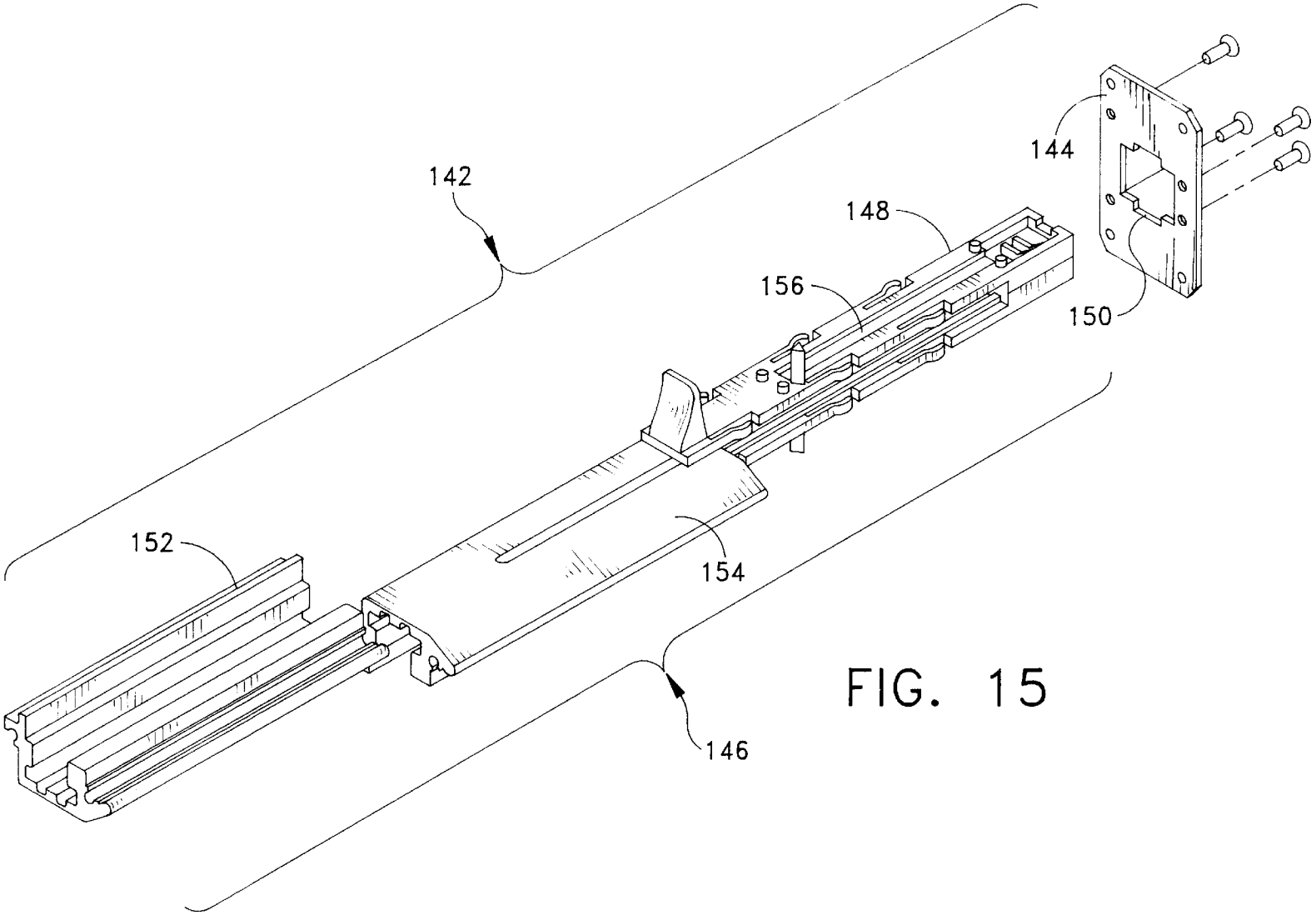
FIG. 15 is an exploded perspective view of the sensor illustrated in FIG. 14.

A sensor is generally indicated at 142 in FIGS. 14 and 15 of the drawings for detecting marks (not shown) provided on the print media. During the printing operation, indicia or marks on the print media 22 control the stepping action of the motor for advancing the print media. The sensor 142 is provided for detecting these marks.

The sensor 142 includes a relatively small, rectangularly-shaped plate 144 mounted on the back plate 26 by threaded fasteners (not designated) and a sensor assembly generally indicated at 146 mounted on the plate. The sensor assembly 146 further has a housing 148 received within an opening 150 formed in the plate 144 and a pair of members 152, 154 which are axially slidable on the housing. Specifically, each member 150, 152 has a uniquely configured slot formed therein which receives a mating formation provided on the housing 148. A sensor indicator 156 is mounted on the housing 148 wherein the removal and replacement of the sensor indicator 156 is achieved by axially sliding off the members 150, 152 for revealing the sensor indicator (FIG. 15). The housing 148 and the members 150, 152 are configured for allowing the strip 22 to pass therethrough and for enabling the sensor indicator 156 to detect the markings.

Turning back to FIGS. 3 and 4, the first, second, and third printing stations 42, 44, and 46 are spaced apart from one another a predetermined equal distance. As shown, the third printing station 46 is positioned at a slightly higher elevation on the back plate 26 than the second printing station 44, and the second printing station 44 is positioned at a slightly higher elevation on the back plate than the first printing station 42. The purpose of this positioning is for improving the angle of printing on the media strip 22 by the printing station. Specifically, this construction creates a "stepped path" which enables the print media 22 to enter the print head 70 and platen roller 74 at an angle that is proper for printing. One advantage of the stepped path is that planar heads can be used for the thermal print heads 70 in order to achieve optimum print quality. Optimum print is achieved by dispersing necessary printing pressure evenly across the film 56, 58, and 60 and print media 22. By comparison, a convex print head or near edge print head creates a concentrated pressure point on the film 56, 58, and 60 and media 22, thus inhibiting film transfer and inducing film wrinkle which both cause poor print quality.

Another advantage of the stepped path is that it provides more back tension on the print media 22. The greater the back tension on the print media 22 the better the registration from print station to print station and from label to label. The increased back tension also allows for easier set up from one style of print media to the next.

Still referring to FIGS. 3 and 4, first and second guide rollers 158, 160 are further provided for improving the angle of the print media 22 through the printing stations 42, 44, and 46. The first guide roller 158 is positioned between the first and second printing stations 42, 44 adjacent the first printing station 42 along a horizontal plane substantially parallel to the first printing station. Similarly, the second guide roller 160 is positioned between the second and third printing stations 44, 46 adjacent the second printing station 44 along a horizontal plane substantially parallel to the second printing station.

These guide rollers 158, 160 ensure that the print media 22 runs parallel with respect to the thermal print head 70. The guide rollers 158, 160 ensure that the path of the strip 22 of print media is parallel to the flat surfaces of the thermal print heads 70 while the strip 22 is travelling through the printing stations 42, 44, and 46. Also, the guide rollers 158, 160 assist in angling the strip 22 upwardly from one printing station to the next, thereby creating the stepped path described above.

Figure 16:
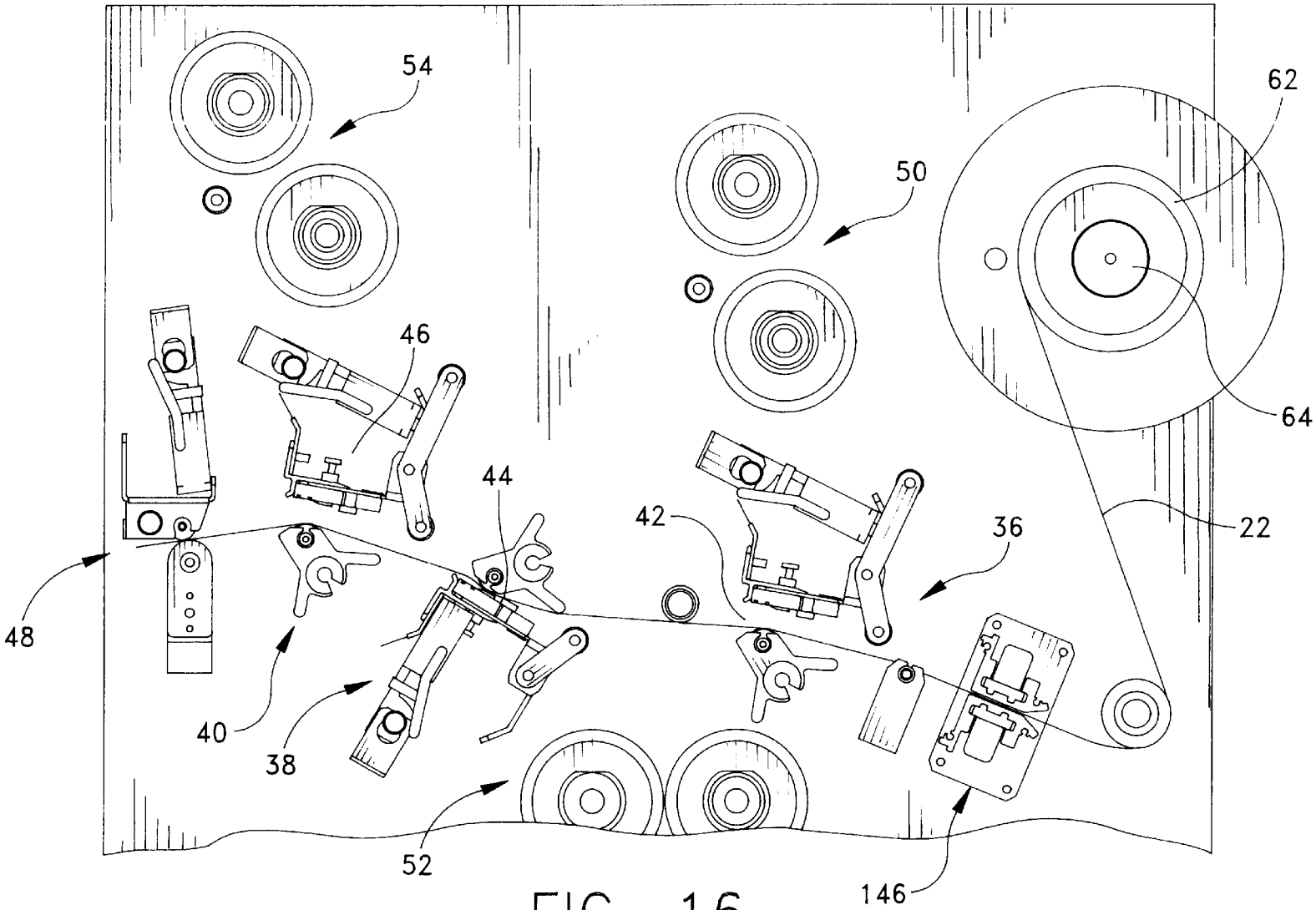
FIG. 16 is a front elevational view of the thermal printing apparatus illustrating the thermal printing assemblies in a variety of positions.

Referring to FIG. 16, the three printing stations 42, 44, and 46 are illustrated in varying positions. Specifically, the first and third printing stations 42, 46 are in position so that the upper surface of the print media 22 is printed upon. It should be noted that the cams 80 of the first and third printing stations 42, 46 are not engaging their respective pivotable arms 78 thus placing the pivotable arms in their intermediate operating position. Upon pivoting the cams 80 in a clockwise direction so that they engage their respective pivotable arms 78, the pivotable arms will achieve their operating positions. The second printing station 44 is positioned for printing the underside or lower surface of the print media 22. Suitable openings (not shown) are formed in the back plate 26 for mounting the aforementioned components of the second printing station 44 thereon.

It can therefore be seen that the instant invention provides a novel and effective apparatus 20 for applying multiple images to either or both upper and lower sides of a continuous strip 22 of print media. The apparatus 20 includes three printing assemblies 36, 38, and 40 which are individually operable for applying an image to the surface of the strip 22. In one type of set-up, all three printing assemblies 36, 38, and 40 are mounted for applying images to a single side of the strip 22. However, a second printing station 44 of the second printing assembly 38, for example, is reversible so that at least one image can be applied to the underside of the strip 22. The apparatus 20 thus allows for the printing of multiple images on the upper side of the strip 20, while simultaneously allowing the printing of an image onto the underside of the strip 22. The multiple image printing of the apparatus 20 combined with the reversibility of two of the printing assemblies makes it highly effective for printing labels and tags for the garment industry, as well as other applications in the retail industry.

In addition, and perhaps more importantly, the stepped path configuration of the printing stations 42, 44, and 46 ensures high quality printing. Moreover, the component parts of the printing stations 42, 44 and 46, the feed assembly 48, and the sensor 142 further ensure easy maintenance replacement. For all of these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for applying images to opposite first and second sides of a continuous strip comprising:

a back plate;

first, second, and third printing means each being cooperatively actuatable for applying first, second, and third images to a continuous strip at first, second, and third printing stations, said first, second, and third printing stations having a predetermined equal distance therebetween wherein the third printing station is positioned at a slightly higher elevation on the back plate than the second printing station and the second printing station is positioned at a slightly higher elevation on the back plate than the first printing station;

first and second guide rollers, the first guide roller being positioned between the first and second printing stations adjacent the first printing station along a horizontal plane substantially parallel to the first printing station, and the second guide roller being positioned between the second and third printing stations adjacent the second printing station along a horizontal plane substantially parallel to the second printing station; and drive means comprising a rotatable drive roller for longitudinally advancing said strip so that it passes through said first, second, and third printing means.

2. The apparatus as set forth in claim 1, each printing station including a thermal printing assembly having a thermal print head and a print head pivoting mechanism, and a platen assembly having a rotatable platen roller and a platen roller mechanism.

3. The apparatus as set forth in claim 2, said strip passing intermediate said thermal print head and said platen.

4. The apparatus as set forth in claim 3, said first, second and third print means each comprising a thermal printing film passing intermediate and strip and said thermal print head.

5. The apparatus as set forth in claim 2, the thermal printing assembly and the platen assembly being mounted on the back plate and being in generally vertical relation with one another.

6. In an apparatus for applying images to at least one side of a continuous strip comprising a back plate, at least one printing means for applying an image to a continuous strip at a printing station, and drive means including a rotatable drive roller for longitudinally advancing said strip so that it passes through said printing means, each printing station comprising:

a thermal printing assembly including a print head pivoting mechanism having a pivotable arm with a thermal print head mounted thereon, said pivotable arm being pivotable between an operating position and a non-operating position, and a pivotable cam which is pivotable between a first position in which it engages the arm when the arm is in its operating position and a second position in which it is pivoted away from the arm; and a platen assembly including a rotatable platen roller and a platen roller mechanism, the thermal print head of the pivotable arm being closely adjacent the platen roller when the arm is in its operating position.

7. In the apparatus set forth in claim 6, said cam being releasably mounted on the back plate and comprising a cam shaft mounted on said back plate, a main body axially and releasably mounted on the cam shaft, and means for releasing the main body from the cam shaft.

8. In the apparatus as set forth in claim 7, said means for releasing the main body from the cam shaft comprising a spring clip mounted on the main body and engageable with an end portion of the cam shaft having an annular recess formed therein, said spring clip being disposed within the annular recess for maintaining the main body and cam shaft in assembled relation.

9. In the apparatus as set forth in claim 7, said main body having a bore formed therein through which the cam shaft is received when mounting the main body on the cam shaft, and at least one engagement element mounted on the main body and engageable with the pivotable arm of the pivoting mechanism.

10. In the apparatus as set forth in claim 9, said engagement element being mounted on the main body by means for adjusting pressure of the engagement element on the pivotable arm.

11. In the apparatus as set forth in claim 6, said platen roller mechanism having a roller shaft mounted on the back plate and a roller bracket axially and releasably mounted on the roller shaft, said roller bracket being adapted to releasably receive the platen roller.

12. In the apparatus as set forth in claim 11, the roller bracket having a pair of spaced apart receiving cutouts for receiving opposite ends of the platen roller.

13. In an apparatus for applying images to at least one side of a continuous strip comprising a back plate, at least one printing means for applying an image to a continuous strip at a printing station, and drive means including a rotatable drive roller for longitudinally advancing said strip so that it passes through said printing means, each printing station comprising:

a thermal printing assembly including a thermal printing pivoting mechanism and a thermal print head mounted thereto; and a platen assembly including a rotatable platen roller and a platen roller mechanism, the thermal print head being closely adjacent the platen roller when the arm is in its operating position, said platen roller mechanism having a roller shaft mounted on the back plate and a roller bracket axially and releasably mounted on the roller shaft, said roller bracket being adapted to releasably receive the platen roller.

14. In the apparatus as set forth in claim 13, the roller bracket having a pair of spaced apart receiving cutouts for receiving opposite ends of the platen roller.

15. An apparatus for applying images to at least one side of a continuous strip comprising:

a back plate;

at least one printing means mounted on the back plate for applying an image to a continuous strip at a printing station, each printing station comprising a thermal printing assembly including a print head pivoting mechanism having a pivotable arm with a thermal print head mounted thereon, said pivotable arm being pivotable between an operating position and a non-operating position, and a platen assembly including a rotatable platen roller and a platen roller mechanism, the thermal print head of the pivotable arm being closely adjacent the platen roller when the arm is in its operating position;

drive means including a rotatable drive roller mounted in rotating fashion on the back plate for longitudinally advancing said strip so that it passes through said printing means; and sensor means comprising a plate mounted on the back plate, a sensor assembly including a housing received within an opening formed in the plate and a pair of members which are axially slidable on the housing, and a sensor indicator mounted on the housing, wherein the removal and replacement of the sensor indicator is achieved by axially sliding off the members for revealing the sensor indicator.

16. The apparatus as set forth in claim 15, said drive means further comprising a cantilevered arm having one end mounted on the back plate, said cantilevered arm having a support plate releasably secured to an opposite end thereof, said drive roller having one end mounted in rotating fashion on the back plate and an opposite end mounted in rotating fashion on the support plate, said drive roller cooperating with an idler shaft for advancing said strip.

17. An apparatus for applying images to at least one side of a continuous strip comprising:

a back plate;

at least one printing means mounted on the back plate for applying an image to a continuous strip at a printing station, each printing station comprising a thermal printing assembly including a print head pivoting mechanism having a pivotable arm with a thermal print head mounted thereon, said pivotable arm being pivotable between an operating position and a non-operating position, and a platen assembly including a rotatable platen roller and a platen roller mechanism, the thermal print head of the pivotable arm being closely adjacent the platen roller when the arm is in its operating position; and drive means for longitudinally advancing said strip so that it passes through said printing means, said drive means comprising a drive assembly having a drive roller, and a cantilevered arm having one end mounted on the back plate, said cantilevered arm having a support plate releasably secured to an opposite end thereof, said drive roller having one end mounted in rotating fashion on the back plate and an opposite end mounted in rotating fashion on the support plate.

18. An apparatus for applying images to at least one side of a continuous strip comprising:

a back plate;

at least one printing means mounted on the back plate for applying an image to a continuous strip at a printing station, each printing station comprising a thermal printing assembly including a print head pivoting mechanism having a pivotable arm with a thermal print head mounted thereon, said pivotable arm being pivotable between an operating position and a non-operating position, and a pivotable cam which is pivotable between a first position in which it engages the arm when the arm is in its operating position and a second position in which it is pivoted away from the arm, and a platen assembly including a rotatable platen roller and a platen roller mechanism, the thermal print head being closely adjacent the platen roller when the arm is in its operating position, said platen roller mechanism having a roller shaft mounted on the back plate and a roller bracket axially and releasably mounted on the roller shaft, said roller bracket being adapted to releasably receive the platen roller; drive means for longitudinally advancing said strip so that it passes through said printing means, said drive means comprising a drive assembly having a drive roller, a cantilevered arm having one end mounted on the back plate, said cantilevered arm having a support plate releasably secured to an opposite end thereof, said drive roller having one end mounted in rotating fashion on the back plate and an opposite end mounted in rotating fashion on the support plate, and an idler shaft which cooperates with the drive roller; and sensor means comprising a plate mounted on the back plate, a sensor assembly including a housing received within an opening formed in the plate and a pair of members which are axially slidable on the housing, and a sensor indicator mounted on the housing, wherein the removal and replacement of the sensor indicator is achieved by axially sliding off the members for revealing the sensor indicator.

19. In the apparatus set forth in claim 18, said cam being releasably mounted on the back plate and comprising a cam shaft mounted on said back plate, a main body axially and releasably mounted on the cam shaft, and means for releasing the main body from the cam shaft.

20. In the apparatus as set forth in claim 19, said means for releasing the main body from the cam shaft comprising a spring clip mounted on the main body and engageable with an end portion of the cam shaft having an annular recess formed therein, said spring clip being disposed within the annular recess for maintaining the main body and cam shaft in assembled relation.

21. In the apparatus as set forth in claim 19, said main body having a bore formed therein through which the cam shaft is received when mounting the main body on the cam shaft, and at least one engagement element mounted on the main body and engageable with the pivotable arm of the pivoting mechanism.

22. In the apparatus as set forth in claim 21, said engagement element being mounted on the main body by means for adjusting pressure of the engagement element on the pivotable arm.

23. In the apparatus as set forth in claim 18, said platen roller mechanism having a roller shaft mounted on the back plate and a roller bracket axially and releasably mounted on the roller shaft, said roller bracket being adapted to releasably receive the platen roller.

24. In the apparatus as set forth in claim 23, the roller bracket having a pair of spaced apart receiving cutouts for receiving opposite ends of the platen roller.

25. In the apparatus as set forth in claim 18, the roller bracket having a pair of spaced apart receiving cutouts for receiving opposite ends of the platen roller.

* * * * *